United States Patent [19]

French et al.

[11] Patent Number: 4,547,026

[45] Date of Patent: Oct. 15, 1985

[54] SEAL ARRANGEMENT FOR COMPACT STORAGE SYSTEMS

[75] Inventors: Robert J. French, Wadsworth; Elmer F. Dorony, Parma, both of Ohio

[73] Assignee: Interior Steel Equipment Co., Cleveland, Ohio

[21] Appl. No.: 630,992

[22] Filed: Jul. 13, 1984

Related U.S. Application Data

[63] Continuation of Ser. No. 394,146, Jul. 1, 1982, abandoned.

[51] Int. Cl.[4] ..... D47B 53/02

[52] U.S. Cl. ..... 312/201; 312/296

[58] Field of Search ..... 312/201, 198, 296; 49/368, 370, 496; 206/504; 220/23.4

[56] References Cited

U.S. PATENT DOCUMENTS

| | | | |
|---|---|---|---|
| 2,684,508 | 7/1954 | Meyers et al. . | |
| 3,467,395 | 9/1969 | Kan | 277/153 |
| 3,837,120 | 9/1974 | Hanks et al. | 312/296 |
| 3,923,354 | 12/1975 | Young | 312/201 |
| 3,967,868 | 7/1976 | Baker, Jr. . | |
| 4,084,125 | 4/1978 | King | 312/201 X |
| 4,196,953 | 4/1980 | Krakow | 312/201 |
| 4,281,838 | 8/1981 | Persson | 277/152 |
| 4,349,206 | 9/1982 | Simm et al. | 277/152 |

FOREIGN PATENT DOCUMENTS

| | | | |
|---|---|---|---|
| 1342662 | 2/1964 | France . | |
| 503546 | 8/1968 | U.S.S.R. | 277/152 |

*Primary Examiner*—William E. Lyddane
*Assistant Examiner*—Joseph Falk
*Attorney, Agent, or Firm*—Yount & Tarolli

[57] ABSTRACT

A multi-unit storage system comprised of individual storage units reciprocally movable on underlying tracks extending in a linear direction is provided with a seal arrangement between adjacent storage units which peripherally seals a storage space internal to the units from the exterior environment when the units are in a closed position.

8 Claims, 6 Drawing Figures

SEAL ARRANGEMENT FOR COMPACT STORAGE SYSTEMS

This application is a continuation of application Ser. No. 394,146, filed July 1, 1982 now abandoned.

BACKGROUND OF THE DISCLOSURE

The present invention relates to the art of multi-unit storage systems of the type having relatively movable individual units for storage of articles therein and, more particularly, to a seal arrangement between adjacent ones of the storage units in such a system for sealing the storage space between the adjacent units when they are in a closed position.

A number of multi-unit type storage systems are available for a variety of storage purposes. Among such systems are those which include a plurality of individual storage units supported, such as on underlying tracks, for relative displacement toward and away from one another along a linear path and between open and closed relationship relative to one another. The opposed sides of the adjacent units have planar wall portions including peripheral areas which are generally parallel to one another. In the open position, an aisleway is provided between the adjacent units to facilitate access to the storage space or spaces thereof, and in the closed position of the units the peripheral wall portions are disposed in substantially abutting relationship. Often, these systems are provided for storing articles under special conditions which may be of critical importance in connection with protecting and preserving the articles. For example, museum collections, archeological artifacts, and the like may require storage in a protective environment with respect to such conditions as temperature, humidity, light, dust or insects. Furthermore, certain articles may even require storage in a special protective environment which either keeps out a harmful atmosphere, or provides a protective atmosphere such as a fumigant.

Such a storage system may be located in a room specifically constructed therefor or, as is often the case, in an existing room which is larger than necessary for the components of the system. Heretofore, the adjacent storage units have not been sealed relative to one another in the closed position and, therefore, special environmental conditions with respect to articles to be stored therein has to be achieved with respect to the room in which the system is located. For example, the entire room may have to be specially sealed and provided with special atmospheric conditions such as temperature and humidity. Such special requirements for a storage room are not only undesirably expensive to provide but, additionally, undesirably limit use of the storage system. In this respect, only certain articles to be stored may require the particular environmental conditions provided for the room, and the latter conditions may not be suitable with respect to the requirements for other articles to be stored. Thus, a separate storage room and system must be provided for such other articles. Additionally, the situation often arises where only a few of the total articles to be stored require a special protective atmosphere such as a fumigant, for example, and although the remaining articles may be compatible with such an atmosphere, fumigating the entire room for the few articles is undesirably expensive and wasteful. Furthermore, in connection with a storage system which occupies only a portion of the area of a room in which it is located, even if all the articles to be stored require the same storage conditions, use of the remaining space in the room such as for occupancy by personnel, can be precluded in that the storage conditions create an intolerable working environment. Accordingly, it will be appreciated that such systems heretofore provided have not enabled optimizing the use of available space either in the storage units or in a room in which the system is located.

SUMMARY OF THE INVENTION

The present invention provides an improved multi-unit type storage system which overcomes the above problems, and others, and enables protecting valuable articles in the individual storage units of the system with the same or different storage conditions in the individual units and without having to maintain special environmental conditions exteriorly of the storage system. More particularly in accordance with the present invention, a storage system is provided which comprises a plurality of individual storage units movable along a linear path between open and closed positions relative to one another and in which adjacent ones of the units have opposed sides which are sealed peripherally when in the closed position. At least one of the adjacent storage units provides an interior storage space and, in the closed position, the seal arrangement seals the interior storage space of the unit from the external environment. In the open position an aisleway is formed between the adjacent units providing for access to the interior storage space. As is well known in such multiunit systems, the relative displacement capability enables moving any two adjacent units to the open position without necessarily opening others of the units. Accordingly, it will be appreciated that the desired environmental conditions for any one of the individual storage units can be obtained independent of other storage units in the system or the room in which the system is located, thus optimizing use of both the storage space available within the system and the exterior space which may be available in the room. Additionally, with respect to special atmospheres such as a fumigant, waste and thus costs are considerably reduced.

Preferably, the peripheral seal arrangement is comprised of laterally offset parallel rigid plate members each extending about the periphery of a different one of the opposed sides of the adjacent storage units, and an elastomeric sealing strip carried by one of the plate members for movement with the corresponding storage unit and sealingly engagable with the plate member on the other unit when the adjacent units are closed. The elastomeric strip has a flexible sealing protion which laterally engages the plate member on the other unit, and may include a second sealing portion which engages the latter unit to provide a double sealing engagement sealing the interior storage space defined by the adjacent storage units.

The primary object of the present invention is to provide a multi-unit storage system in which a storage space between adjacent relatively displaceable individual storage units is peripherally sealed when the units are in a closed position relative to one another.

Another object is the provision of a multi-unit storage system of the foregoing character which enables optimizing use of the available storage space within the system as well as the use of available space in a room or the like in which the system is located.

A further object is the provision of a multi-unit storage system of the foregoing character which enables the storage of like or different articles in different ones of the storage units and with like or different environmental conditions in the storage units.

Still a further object is the provision of a multi-unit storage system of the foregoing character which optimizes protecting articles being stored from undesirable external environmental conditions, and which enables maintaining a desired conditon within the storage space of one storage unit independent of others of the storage units in the system.

Still another object is the provision of a sealing arrangement between peripheral portions of the opposed sides of adjacent storage units operable upon movement of the adjacent units toward one another to peripherally seal the storage space therebetween and which do not operate to urge the units apart.

Yet a further object is the provision of a peripheral sealing arrangement between adjacent storage units including a resilient elastomeric sealing member carried by one of the units and which is resiliently deformable upon engagement with the other unit to provide sealed engagement between the units and peripherally thereof.

Still another object is the provision of a sealing arrangement of the foregoing character which is structurally simple, economical to construct and install on adjacent storage units, and which is extremely efficient in connection with peripherally sealing the storage space between the adjacent units.

BRIEF DESCRIPTION OF THE DRAWINGS

The foregoing and other objects and advantages will become apparent from the following description of preferred embodiments illustrated in the accompanying drawings in which.

DESCRIPTION OF PREFERRED EMBODIMENTS

Figure 1:
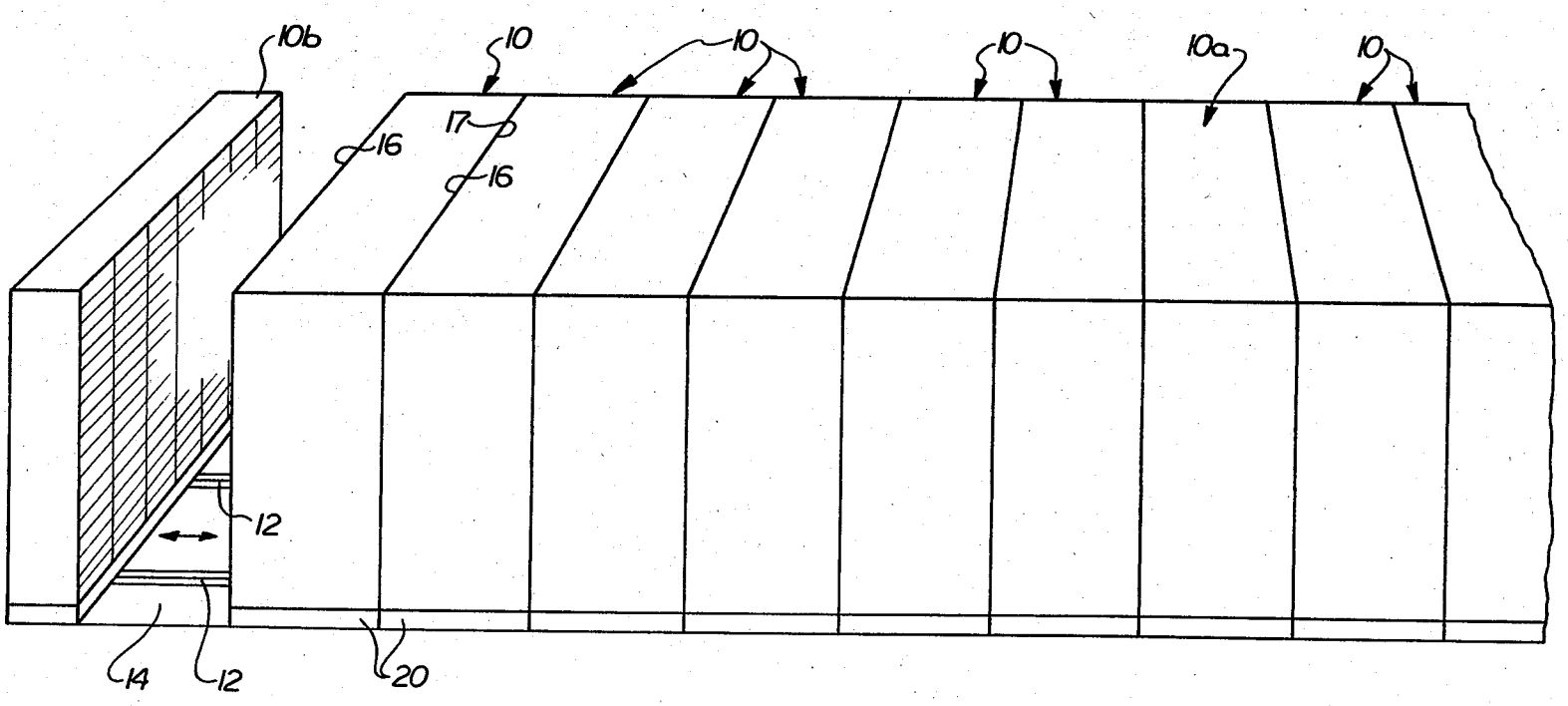
FIG. 1 is a perspective view of a multi-unit storage system incorporating a sealing arrangement according to the present invention.

Referring now to the drawings wherein the showings are for the purpose of illustrating preferred embodiments of the invention only and not for the purpose of limiting the invention, a portion of a multi-unit storage system of the general type to which the present invention is directed is shown in FIG. 1 as being comprised of a plurality of individual storage units 10, the number and size of which, in a given system, will vary in accordance with such factors as the quantity of articles to be stored and the space available for the system. As is well known in such storage systems, the individual units 10 are supported for relative displacement such that adjacent units can be moved between open and closed positions relative to one another. This provides for closing the entire system and for separating adjacent units to provide an aisleway therebetween enabling access to the articles in the storage space provided by at least one of the adjacent units. For this purpose, and as is well known in the art, individual storage units 10 may, for example, be supported on underlying tracks 12. Tracks 12 provide for the storage units 10 to be supported and guided for movement in opposite directions along a linear path as represented by arrow P in FIG. 1 and, as will become apparent hereinafter, adjacent ones of the storage units 10 have opposed sides lying in planes transverse to path P. In such a multi-unit storage system, one of the individual storage units may be maintained stationary with respect to tracks 12 and the remaining storage units are displaceable relative thereto and to one another. In this respect for example, in a storage system which is of considerable length with respect to the direction of path P such as the system partially illustrated in FIG. 1, an individual storage unit centrally of the opposite ends of the system such as represented by numeral 10*a* in FIG. 1 can be maintained stationary. Accordingly, the units 10 on opposite sides of unit 10*a* with respect to path P are displaceable relative thereto and to one another. In such an arrangement, the opposite ends of the storage system would be defined by end storage units such as the unit 10*b* in FIG. 1 which, when closed against the adjacent unit 10 in the direction toward stationary unit 10*a* provides for the entire storage system to be closed. As will be appreciated from FIG. 1, displacement of end unit 10*b* along tracks 12 to the position illustrated in which it is spaced from the adjacent unit 10 provides an aisleway 14 enabling access to the storage space provided by the unit. As will likewise be appreciated, end unit 10*b* and any one or more of the units 10 between the end unit and stationary unit 10*a* can be displaced to the left in FIG. 1 to provide such an access aisleway between adjacent ones of the individual units. In a storage system which is short with respect to the direction of path P, it will be appreciated that an end unit of the system such as unit 10*b* could be maintained stationary with respect to tracks 12 and the remaining units including an end unit at the opposite end of the system would be displaceable relative to one another and the stationary end unit.

In accordance with the present invention, the opposed sides 16, 17, extending transversely of the rails 12, of adjacent ones of the individual storage units 10 in a storage system of the foregoing character are provided with peripherally continuous sealing arrangements S, as described in detail hereinafter, which provide a seal for the storage space within the adjacent units when the latter are in the closed position. Sealing arrangements S enable maintaining a desired storage condition within the individual storage unit and independent of the condition to be maintained in storage units elsewhere in the system, and/or conditions esisting or to be maintained exteriorly of the system. The particular structure of the individual storage units is not important beyond the fact that at least one of two adjacent units provides a storage space and that the facing interior sides 16, 17 of the adjacent storage units each have a peripheral portion providing or enabling the support of sealing components which interengage when the units are closed. The individual storage units to be described hereinafter in connection with the disclosed embodiments are structured to provide storage spaces opening into the opposite sides of each unit, whereby the storage spaces of adjacent units open towards one another providing two storage spaces therebetween when the units are in the closed position. However, it will be appreciated that each of the individual storage units could have a closed back facing the open side of the adjacent unit, whereby the latter unit would provide the storage space between the units when in the closed position. Further, with regard to the ensuing description of one of the storage units 10 and the sealing arrangements between adjacent storage units, it will be appreciated that the storage units are of the same structure and the sealing arrangements between adjacent units are the same, whereby the description thereof is applicable to the other storage units in the storage system.

Figure 2:
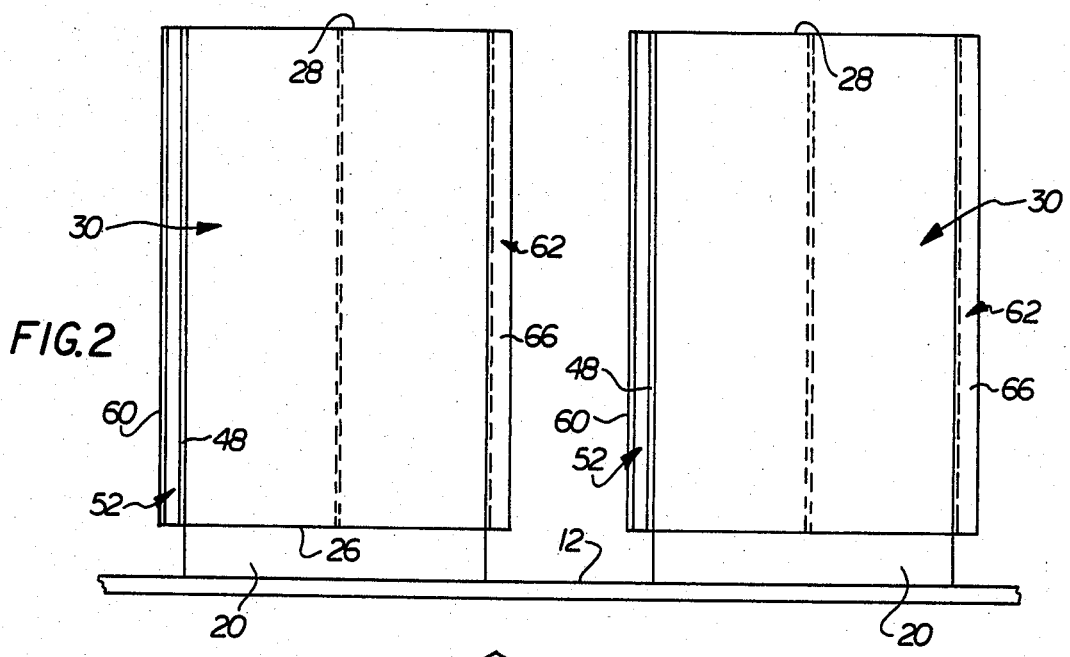
FIG. 2 is a side elevation view illustrating spaced apart adjacent storage units and the component parts of a preferred sealing arrangement therebetween.
Figure 3:
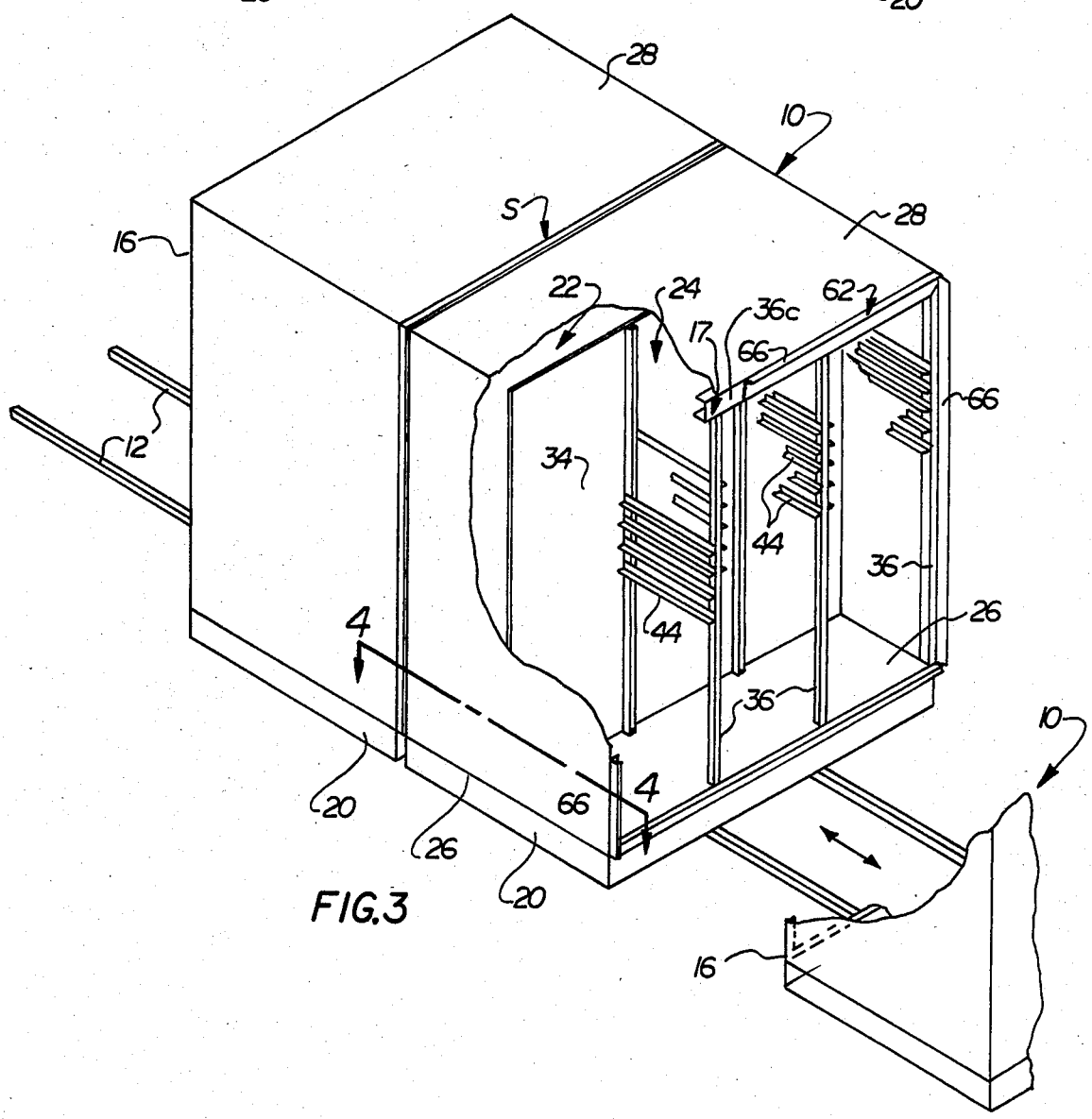
FIG. 3 is a perspective view illustrating adjacent storage units in closed sealing relationship with respect to one another.
Figure 4:
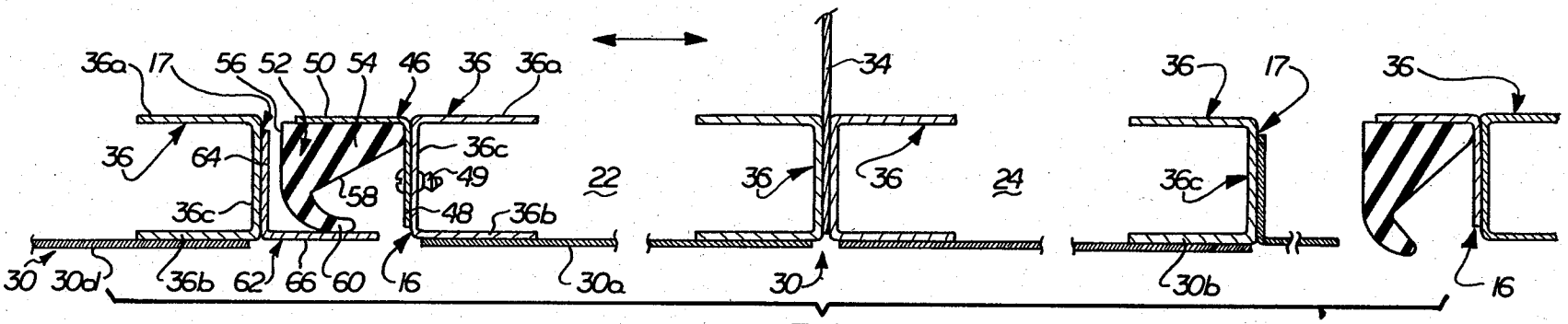
FIG. 4 is an enlarged cross-sectional view taken along line 4—4 in FIG. 3 and showing a preferred sealing structure in accordance with the present invention.

Referring now to FIGS. 2–4 of the drawing, each of the storage units 10, including units 10*a* and 10*b*, is of sheet metal construction and is suitably mounted on a platform or carriage 20 by which, in turn, is supported on tracks 12, such as by rollers not shown, mounted on the underside of the platform. Each storage unit except the end storage units includes two storage spaces accessible from the interior sides 16 and 17 respectively of the storage unit when that side is forming part of an aisleway. The end storage units have only a single storage space accessible from the interior side of the unit when that side forms an aisleway.

Each side of a storage unit is framed with U-shaped frame members or posts 36 and the top, bottom, and side walls secured there at their peripheral edges as by welding. The construction of side walls 30 is typical and is illustrated in FIG. 4 together with the sealing arrangements. The U-shaped frame members 36 have laterally inner and outer flanges 36*a* and 36*b*, respectively, and a web 36*c* extending therebetween laterally inwardly perpendicular to the corresponding exterior wall. A partition wall 34 is secured such as by welding between the webs 36*c* of the frame members intermediate the longitudinally opposite sides 16, 17 of the storage unit 10.

Thus, it will be appreciated that the opposite interior sides 16, 17 of each storage unit 10 with respect to the direction of path P are each peripherally bounded by inwardly extending webs 36*c* which are substantially coplanar with one another and in a plane transverse to the direction of path P. It will likewise be appreciated therefore that the facing interior sides of adjacent ones of the storage units 10 have corresponding peripheral webs 36*c* facing one another. Preferably, as shown in connection with storage space 22 in FIG. 3, vertically extending U-shaped posts or frame members 36 are suitably secured between bottom wall 26 and top wall 28 and corresponding posts at the partition wall 34 carry horizontal support members 44 which provide guides and supports for shelves, trays, drawers or the like which are used for storing articles in the unit.

Referring to FIG. 4, each of the storage units having two storage areas or spaces comprise top and bottom sides 26 and 28 and opposed exterior sides 30 and 32 joining the top and bottom sides. The exterior side 30 is formed by a wall construction shown in cross-section in FIG. 4. As shown therein, the wall construction comprises the frame members or U-shaped posts 36, extending between the top and bottom sides and two panels 30*a* and 30*b* of sheet metal. The panels 30*a*, 30*b* are welded to the outside of the end posts 36 of the wall and to two adjacent intermediate posts 36 at opposite sides of the partition 34. The latter is also preferably secured to the adjacent posts 36 as by welding.

The side wall construction for all exterior sides of the units and the intermediate wall dividing the units into two spaces may correspond to the side wall construction described. For the end units, as in the case of 10*b*, the wall 34 may provide the outside end wall of the unit and the system.

The webs 36*c* of the vertical posts 36 and corresponding webs on similar members extending across the top and bottom of each interior side 16, 17 form a peripheral edge structure which supports sealing components of sealing arrangements which cooperate so that when adjacent storage units are closed the environment inside is sealed. The sealing arrangement S is structurally identical for each of the facing peripheral edges of adjacent units 10 and includes cooperating sealing components on each of the sides. It will be appreciated that the description of sealing arrangements S as shown in detail in FIG. 4 with respect to walls 30 of adjacent units and the peripheral edges of their facing sides 16, 17 is applicable to the sealing arrangement around the periphery of the interior sides 16, 17 of the various units.

The sealing component on the peripheral edges for the interior sides 16 of units comprise L-shaped members 46 each having a plate portion 48 overlying and suitably secured, such as by screws 49, to a web 36*c* defining the peripheral edge of the side and a plate portion 50 generally extending toward the other adjacent unit from the interior edge of web 36*c* to which it is fastened. A sealing element 52 is mounted on plate portions 50 to project across the web to project exteriorly of the adjacent wall, e.g., wall 30, when the respective unit is open and forms part of an aisleway. Each sealing element 52 is of a resilient elastomeric material, such as Neoprene, and includes base portion 54 by which the sealing element is secured to its plate portion 50 such as by adhesive bonding. The base portion of elastomeric material includes a generally planar outer end face 56, preferably positioned outwardly of the end of corresponding plate portion 50, and an inclined inner face 58 converging outwardly from the base portion and terminating in a curved sealing lip 60. The contour of the base portion provides stability for the flexible sealing lip 60, the latter extending co-extensively with the base portion 54. The sealing lip at its free end curves laterally and inwardly toward the plate portion 48 mounted peripherally on the edge of the interior side 16.

The peripheral edge of side 17 of the adjacent storage unit 10 is provided with a cooperative sealing component in the form of L-shaped members on the peripheral edge of side 17 which define deflector means extending around the peripheral edge of the side 17 and which extend toward the adjacent storage unit from adjacent the end of the outer side of the wall 30. The L-shaped members comprise a plate portion 64 secured, such as by screws, to the peripheral edge formed by the webs 36*c* of the U-shaped frame members 36, and a plate portion 66 generally adjacent the plane of the exterior wall of the unit and extending toward the side 16 of the adjacent unit carrying the cooperating sealing component. Plate portions 64 and 66 are coextensive with the corresponding webs 36*c* forming the peripheral edge of the respective side 17. When moving the adjacent units to engage the sealing components of a sealing assembly, the plate portions 66 engage the sealing lip 60 of the sealing element 52 to displace the sealing lip from the disposition shown at the right hand side of FIG. 4 to that shown at the left hand side wherein the storage units are shown closed. Accordingly, it will be appreciated that the storage space between the adjacent units is sealed peripherally thereabout when the units are closed.

It will be noted that the sealing lip 60 extends outwardly of the deflecting plate portion 66 of its cooperating sealing elements and outwardly of the wall 30. By so extending, close tolerances do not have to be maintained with respect to the constructing and mounting of the units 10 on the platforms 20 and the rails 12 to obtain a proper sealing action. As the units are closed to effect the sealing arrangement the lip will be deflected and the seal will occur along the outside face of sealing lip 60 as illustrated in the left hand portion of FIG. 4. It will be noted that the type of sealing arrangement described does not apply spring forces tending to urge the adjacent units apart from each other. Instead the resilient forces are basically applied in a plane perpendicular to the tracks 12.

It has been found that the U-shaped frame members forming the interior peripheral edges of the sides 16, 17 of the units can be first assembled with the sealing elements thereon and with the frame members and the sealing components mitered, for assembly into the unit, the mitered resilient lip 60 will, at the corners, compress upon itself to provide an effective seal when the units are arranged as shown in FIG. 4. It will be appreciated that the components of a sealing arrangement between units can be reversed so that the plates 66 lie along the inside of the exterior walls and the plates 50 along the interior walls.

Figure 5:
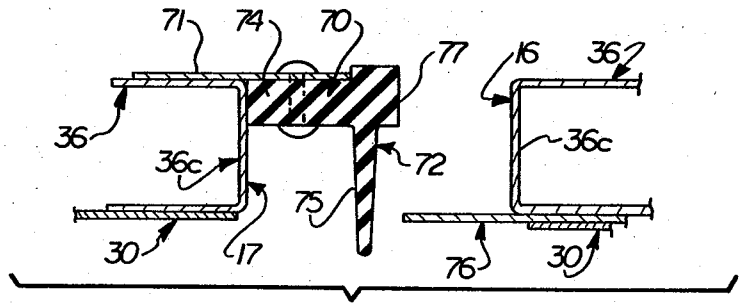
FIG. 5 shows a modification of the embodiment in FIG. 4.

FIG. 5 of the drawing illustrates a modificiation of the sealing arrangement S which provides for adjacent units to be sealed in accordance with the present invention. More particularly, a resilient sealing component 70 is mounted on the peripheral edge of the opening interior side 17 of the units and the cooperating deflecting means for the resilient sealing component 70 is mounted on the peripheral edges of the open interior side 16 of the storage units.

As illustrated in FIG. 5, the resilient sealing component 70 comprises a plate 71 which is fastened to, as by screws or welding, the interior side of the U-shaped frame members forming the peripheral edge of the open interior side 17 of a unit. The plates extend outwardly from the interior side 17 toward the adjacent storage unit with the respective plates extending parallel to the interior side of the U-shaped frame member upon which they are mounted. A sealing element 72 is mounted on these and is modified from that shown in FIG. 4. As shown in FIG. 5, the resilient sealing element 72 comprises a sealing element having substantially rectangular base 74 fixed in an appropriate manner as by riveting, screws or bonding, to its plate 71 which extends from the peripheral edge. The sealing element 72 further has a sealing lip 75 extending from the base generally parallel to interior side 17 to the exterior of the unit and beyond as described in connection with the sealing lip 60. In the embodiment of FIG. 5, the sealing lip is basically a straight lip without a curve as in the embodiment of FIG. 4.

The cooperating element on the adjacent peripheral edge of the interior side 16 of the adjacent storage unit comprises a plate means 76 defining a substantially continuous plate around the peripheral edge with the plate means being welded to the exterior sides of the U-shaped frame members with the respective sheet metal side, top, or bottom being welded to the plate means. The plate means provides a substantially continuous plate on the outside of the peripheral side 16 of the units which extends about the full periphery of the open interior side 16. As two adjacent units are moved to a closed position to effect a seal from the open position shown in FIG. 5, the sealing lip 75 will be deflected to form a seal along the plate means 76 extending from the interior side 16 of the adjacent unit. In addition, the projecting end 77 of the resilient element may be provided with a straight side to seal against the face of the web of the U-shaped frame member forming the peripheral edge of the interior side 16 of the adjacent unit. This will provide a double seal arrangement. Depending upon the particular application, the double seal may or may not be used and if only one seal is used, it is preferably the one provided by the lip 75 so as not to create resilient forces tending to push the units apart.

Figure 6:
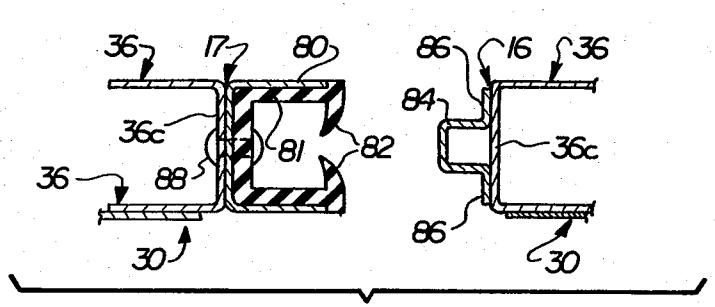
FIG. 6 shows another embodiment of a sealing structure according to the invention.

While a preferred sealing structure has been shown in FIG. 4 and its modification in FIG. 5, it will be appreciated that other sealing element profiles may be adopted to accomplish the purposes of the present invention. For example, as shown in FIG. 6 of the drawing, the sealing arrangements may be mounted on the webs **36*c* of the U-shaped frame members forming the peripheral edge of the facing interior sides 16 and 17 of adjacent units. In FIG. 6 a second U-shaped channel member 80 having a U-shaped sealing element 81 lining the channel is connected to the peripheral edge formed by the U-shaped frame members 36 of the interior side 17 of one storage unit. The U-shaped resilient sealing element has lips 82 extending inwardly from its open end which tend to close the open part of the U facing the interior side 16 of the adjacent unit except for a slot between the lips. The lips receive and seal against, when the units are closed, the sides of a U-shaped channel 84. The U-shaped channel has flanges 86 extending laterally from the top of the U and these are connected to the peripheral edge formed by the web 36*c* of the U-shaped frame members defining the peripheral edge of the interior side 16 of the adjacent unit. The sealing lips define a slot somewhat narrower than the width of the U and have their free ends defining the slot for the sealing element curved to provide an effective seal along the sides of the U-shaped channel received thereby. If a second sealing line is desired, the flanges 86 may also abut the sealing lips 82**.

It will be appreciated from the embodiments illustrated in FIGS. 4 and 5 of the drawing, that the opposed peripheral edge portions of the adjacent storage units are defined either by webs **36*c* and members 46 and 62 in FIG. 4, or by webs 36*c*, plates 76 and plate portion 71 in FIG. 5. It will be further appreciated that the opposed peripheral edges in either event are sealing interengaged by the interposition of sealing element 52 or 70 therebetween. While a preferred sealing element structure is shown for this purpose, it will be appreciated that other sealing element profiles and the mounting thereof on the peripheral portion of one storage unit for sealing engagement with the opposed peripheral portion of the adjacent storage unit can readily be devised. For example, as shown in FIG. 6 of the drawing and again in connection with end walls 30 of adjacent storage units 10, the web 36*c* of one storage unit can be provided with a generally U-shaped channel 80 receiving and supporting a U-shaped sealing element 81 having opposed laterally inwardly extending sealing lips 82 thereon. Sealing element 84 and support member 80 are coextensive with web 36*c* between the bottom and top walls of the corresponding storage unit and are mounted on flange 36** such as by means of rivets 88. The opposed web 36*c* of the adjacent storage unit is provided with a coextensive generally U-shaped channel member 84 which sealingly interengages with lips 82 when the storage units are moved to the closed position. The channel portion 84 has a lateral width greater than the lateral spacing between sealing lips 82, whereby the latter are deflected laterally to sealingly engage the laterally opposite sides of nose portion 84 when the storage units are moved into the closed position.

While adjacent storage units 10 are illustrated herein as having longitudinally opposed open sides each peripherally bounded by U-shaped frame members providing laterally inwardly extending webs 36*c* and inner flanges 36*a*, an equivalent structure can be provided by bending portions of the wall panels at the longitudinally opposite ends thereof to provide integral portions corresponding to the web and flange. Further, the sealing arrangements illustrated herein could be provided between the closed back of one storage unit and the open side of the adjacent unit. In this respect, it will be appreciated from FIG. 4 of the drawing that one of the adjacent storage units 10 could have a back wall extending vertically between the bottom and top walls thereof and laterally between the end walls thereof and attached to flanges 36*c* of the one storage unit. In such case, the backed storage unit would not have a central partition wall and would provide a storage space between the back wall and the open side thereof at the ends of the walls opposite the back wall. In such a storage unit construction, the portion of the back wall laterally inwardly adjacent the bottom, top and side walls of the storage unit would provide a peripheral area on the corresponding storage unit on which one or the other of the members 46 and 62 would be mounted. Thus, upon movement of the adjacent units into the closed position, the sealing elements would interengage peripheral portions about the closed back of one unit and the open side of the other to peripherally seal the storage space therebetween which would be defined by the storage space of the one open sided unit.

While considerable emphasis has been placed herein on the structures and structural interrelationships between the component parts of the storage units and sealing arrangements, it will be appreciated that many embodiments can be made and many changes can be made in the embodiments herein disclosed without departing from the principles of the invention.

Having thus described the invention, it is claimed:

1. A plurality of relatively movable storage units for forming a closed compartment comprising adjacent storage units having respective end sides facing each other, the units being relatively movable along a common linear path from spaced apart positions with an access aisle therebetween to closed positions with said respective end sides immediately adjacent to each other to form a closed storage compartment, said storage units each having between opposite end sides thereof opposed top and bottom walls and opposed side walls extending parallel to said linear path of movement, which walls form the top and bottom walls and opposed side walls of the closed storage compartment, each of said facing end sides of said units having a peripheral edge wall extending about the periphery of the end side, said plurality of units comprising first and second end units having respective end walls extending perpendicularly to the opposed sidewalls for respectively closing the opposite ends of the closed storage compartment, said top and bottom walls and said sidewalls forming said closed storage compartment and being of a construction such that the closed storage compartment can be environmentally controlled apart from the atmosphere external of the closed storage compartment, said adjacent facing end sides of adjacent units having sealing means for effecting a seal between adjacent units when said units of said storage compartment are in a closed position, each of said sealing means comprising cooperating first and second elements extending about the outer periphery of respective facing adjacent end sides to be sealed by the sealing means, means mounting said cooperating first element on the end side of one of the adjacent units and said cooperating second element on the facing end side of the other of the adjacent units, said cooperating first element comprising a projecting portion extending around and projecting from the periphery of the respective end side in a direction generally parallel to the line of relative movement of said units, said cooperating second element comprising a resiliently deflectable portion extending around the periphery of its respective end side and extending across the path of relative movement of said cooperating first element when the adjacent units are relatively moved from an open position to a closed adjacent position so as to be deflected by said cooperating first element, said cooperating first element having a sealing surface extending parallel to said line of relative movement against which the defelcted portion of the cooperating second element bears when the adjacent units are in their closed position so as to apply substantially the entire resilient force thereof resulting from the deflection of said portion by said cooperating first element in a direction perpendicular to said line of movement throughout the peripheral extent of the cooperating elements whereby the resilient sealing forces between said cooperating first and second elements have substantially no resilient force component in the direction of said relative movement.

2. A storage system as defined in claim 1 wherein the top, bottom and side walls of said storage system are of sheet metal and said peripheral edge walls comprise a structural support for said walls of the respective unit and said cooperating first and second elements are comprised of plate-like members extending from their corresponding edge walls, said cooperating second element comprises means mounting said deflectable portion being on the plate-like member of the cooperating second element and the plate-like member of said first cooperating element is offset to move along a path different from the plate-like member for said resilient deflectable portion.

3. A system as defined in claim 1 wherein said cooperating second element comprises a body having resiliently deflectable lip constituting said deflectable portion.

4. A storage system as defined in claim 3 wherein the top, bottom and side walls of said storage system are of sheet metal and said facing end sides of adjacent units comprise peripheral edge walls providing a structural support for said walls of the respective unit and said cooperating first and second elements are each comprised of plate-like members extending from their corresponding edge walls and the deflectable portion of said body is mounted on the plate-like member of said second cooperating element and the plate-like member of said first cooperating element is offset to move along a path different from the plate-like mounting member for said resilient sealing member.

5. A system as defined in claim 1 wherein said second cooperating sealing element comprises a channel-shaped member mounted on the edge wall of its respective end side for receiving said cooperating first element and said deflectable portion comprises a resilient means mounted within the channel with the resilient means having a plurality of deflectable portions which extend inwardly from opposite sides of the channel into the path of the cooperating first element.

6. A storage system as defined in claim 5 wherein the top, bottom and side walls of said storage system are of sheet metal and said peripheral edge walls comprise a structural support for said walls of the respective unit and said cooperating first and second elements are comprised of plate-like members extending from their corresponding edge walls, said resilient means is mounted on the plate-like member of said cooperating second element and the plate-like member of said cooperating first element is offset to move along a path different from the plate-like member for said cooperating second element.

7. A storage system comprising a plurality of adjacent storage units comprising first and second adjacent storage units having adjacent opposed sides, means for supporting said storage units for displacement relative to one another along a common linear path perpendicular to said opposed sides to move adjacent units between closed and open positions relative to one another, each of said opposed sides including means defining peripheral edge means extending thereabout, said storage units comprising wall means providing a closed, environmentally controllable compartment when said units are in closed position, sealing means mounted on and extending around the peripheral edge means of one of said adjacent opposed sides and cooperating with peripheral edge means of the said adjacent opposed side as the units relatively move along said path into a closed position and having two sealing elements to provide a double acting seal between said adjacent opposed sides, one of said sealing elements being compressed by said peripheral edge means in a direction essentially perpendicular to said path of the movement of said opposed sides along said linear path to form one sealing element of said double acting seal and to provide resilient sealing forces having with said one sealing element substantially no component along said path of movement.

8. A storage system comprising a plurality of adjacent storage units comprising first and second adjacent storage units having adjacent opposed sides, means for supporting said storage units for displacement relative to one another along a common linear path perpendicular to said opposed sides to move adjacent units between closed and open positions relative to one another, each of said opposed sides including means defining peripheral edge means extending thereabout, said storage units comprising wall means providing a closed, environmentally controllable compartment when said units are in closed position, and sealing means including a resilient sealing lip extending about the periphery of one of said adjacent opposed sides, said resilient sealing lip extending through said linear path of movement of said adjacent opposed sides when the units are in an open position and being resiliently deflected in a direction transverse to the direction of movement of the adjacent opposed sides along said linear path as the opposed sides move into said closed position to seal said interior storage space and to apply resilient sealing forces acting essentially perpendicular to said path of movement, said forces having substantially no component in the direction of said path.

* * * * *